US007097213B2

(12) United States Patent
Antos et al.

(10) Patent No.: US 7,097,213 B2
(45) Date of Patent: Aug. 29, 2006

(54) LATCHING ARRANGEMENT FOR A REFRIGERATOR DOOR

(75) Inventors: John M Antos, Ann Arbor, MI (US); James C Butler, Sidney, OH (US)

(73) Assignee: Thetford Corporation, Ann Arbor, MI (US)

( * ) Notice: Subject to any disclaimer, the term of this patent is extended or adjusted under 35 U.S.C. 154(b) by 0 days.

(21) Appl. No.: 10/493,359

(22) PCT Filed: Oct. 21, 2002

(86) PCT No.: PCT/US02/33658

§ 371 (c)(1),
(2), (4) Date: Apr. 22, 2004

(87) PCT Pub. No.: WO03/036203

PCT Pub. Date: May 1, 2003

(65) Prior Publication Data

US 2004/0189015 A1 Sep. 30, 2004

(51) Int. Cl.
*E05C 17/04* (2006.01)

(52) U.S. Cl. ..... 292/56; 292/278; 292/11; 292/29; 292/DIG. 71; 312/401; 62/440

(58) Field of Classification Search ..... 292/128, 292/29, 95, 116–119, 56, DIG. 71, DIG. 14, 292/262, 278, 31, 25, DIG. 65; 62/440–441; 312/401, 236
See application file for complete search history.

(56) References Cited

U.S. PATENT DOCUMENTS 2,227,144 A * 12/1940 Krause ..... 292/DIG. 14
2,268,741 A * 1/1942 Dall ..... 292/DIG. 14
2,269,537 A * 1/1942 Krause ..... 292/11
2,270,053 A * 1/1942 Hill et al. ..... 292/DIG. 14
2,286,739 A * 6/1942 Krause ..... 292/DIG. 14
3,161,923 A * 12/1964 Crain ..... 292/128
3,244,830 A 4/1966 Bates
3,621,684 A * 11/1971 Horvay et al. ..... 292/DIG. 71
3,690,708 A * 9/1972 Worley et al. ..... 292/DIG. 71
3,924,085 A 12/1975 Stone
4,930,818 A 6/1990 Gerhardsson
5,988,709 A * 11/1999 Lee et al. ..... 292/DIG. 71
6,550,824 B1 * 4/2003 Ramsauer ..... 292/11
6,616,199 B1 * 9/2003 Tokach et al. ..... 292/56

OTHER PUBLICATIONS

International Search Report for PCT/US02/33658; ISA/210 US; Mailed: May 28, 2004.

* cited by examiner

*Primary Examiner*—Brian E. Glessner
*Assistant Examiner*—Christopher J. Boswell
(74) *Attorney, Agent, or Firm*—Harness, Dickey & Pierce, P.L.C.

(57) ABSTRACT

A latching arrangement for a refrigerator door includes a striker unit, a first latch arm and a second latch arm. The striker unit is secured to a cabinet of the refrigerator. The first latch arm is interconnected to the door for pivotal movement about a generally horizontal axis between a latched position and an unlatched position. In the latched position, the first arm releasably engages a first striker portion of the striker unit. The second latch arm is interconnected to the door for pivotal movement about a generally vertical axis between a latched position and an unlatched position. In the latched position, the second latch arm releasably engages a second striker portion of the striker unit.

12 Claims, 8 Drawing Sheets

LATCHING ARRANGEMENT FOR A REFRIGERATOR DOOR

FIELD OF THE INVENTION

The present invention generally relates to refrigerators. More particularly, the present invention relates to a latching arrangement for a refrigerator door. In one particular form, the present invention relates to a latching arrangement for a refrigerator door that includes a primary latch and a storage latch.

BACKGROUND OF THE INVENTION

Vehicles including but not limited to recreational vehicles ("RVs" in the United States and "Caravans" in Europe), tractor trailers, airplanes, boats, trains, and the like often incorporate refrigerators for the comfort and convenience of the occupants. Such refrigerators conventionally include magnets for retaining the door in a closed position. In addition, some known refrigerators incorporate manually operated latches to further prevent unintended opening of the door during periods of vehicle travel, for example.

While such conventional latching arrangements for refrigerator doors have proven to be satisfactory for their intended use, they are all associated with limitations. For example, most known latching arrangements must be manually actuated and thereby may not always be used. Additionally, many known latching arrangements are not conveniently located and require undesired motion to activate. Furthermore, known latching arrangements do not allow for the door to be secured in an ajar position so as to facilitate proper ventilation during periods of non-use.

Accordingly, it remains a need in the pertinent art to provide a refrigerator door latching arrangement that overcomes the limitations associated with the prior known arrangements, including but not limited to those disadvantages discussed above.

SUMMARY OF THE INVENTION

It is a general object of the present invention to provide a latching arrangement for a refrigerator door which includes a first latch arm for securing the door in a closed position and a second latch arm for securing the door in an ajar position.

It is another object of the present invention to provide a latching arrangement for a refrigerator door that automatically latches the door to a cabinet upon closing of the door.

It is yet another object of the present invention to provide a latching arrangement having a latch arm which is conveniently positioned to facilitate ergonomically efficient unlatching of the door.

In one particular form, the present invention provides a latching arrangement for a refrigerator having a door and a main body. The latching arrangement includes a striker unit, a first latch arm and a second latch arm. The striker unit is secured to the main body. The first latch arm is interconnected to the door for pivotal movement about a generally horizontal axis between a latched position and an unlatched position. In the latched position, the first arm releasably engages a first striker portion of the striker unit. The second latch arm is interconnected to the door for pivotal movement about a generally vertical axis between a latched position and an unlatched position. In the latched position, the second latch arm releasably engages a second striker portion of the striker unit.

Additional advantages and features of the present invention will become apparent from the following description and appended claims, taken in conjunction with the accompanying drawings.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred teachings of the present invention are merely exemplary in nature and are in no way intended to limit the invention, its application, or uses.

Figure 1:
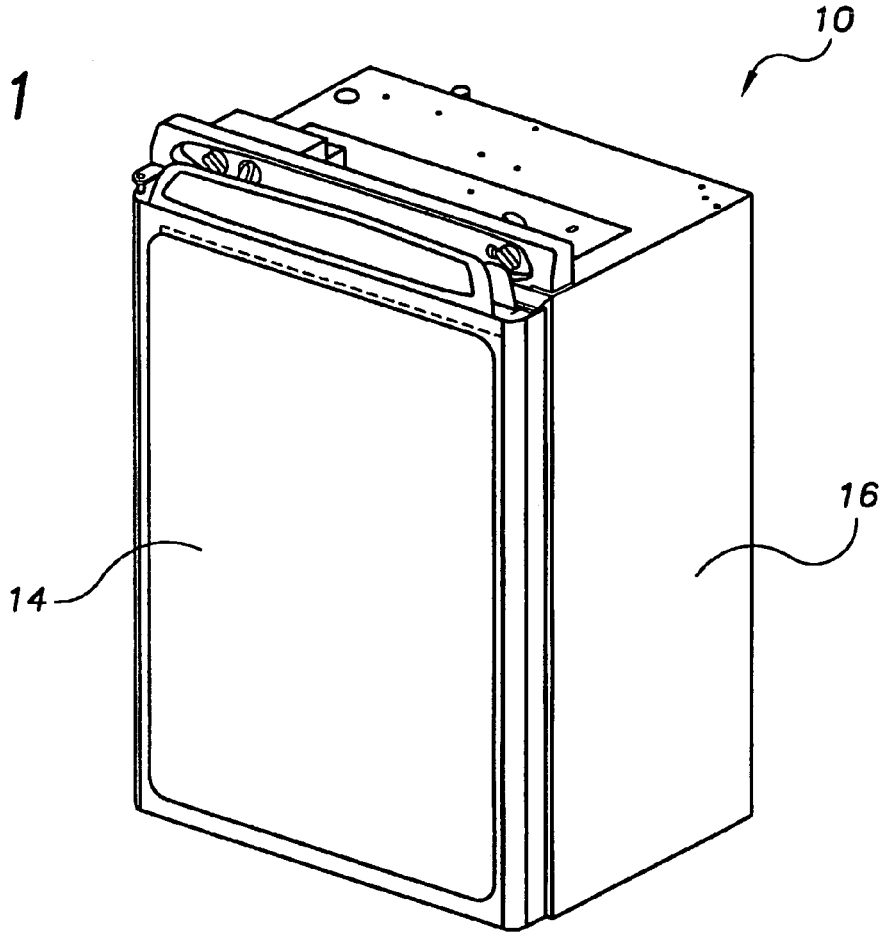
FIG. 1 is a perspective view of a refrigerator incorporating a door latching arrangement constructed according to the teachings of a preferred embodiment of the present invention.
Figure 2:
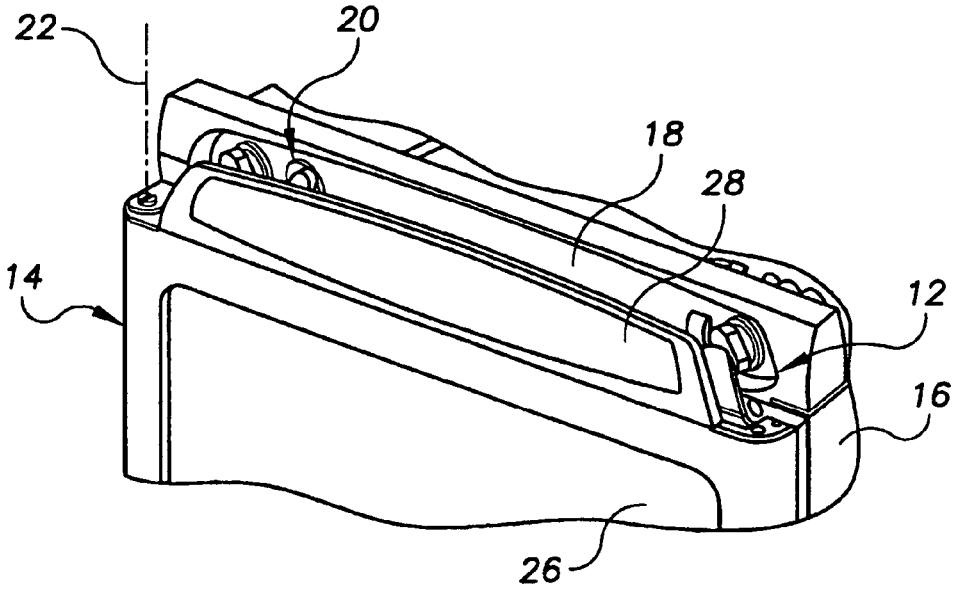
FIG. 2 is an enlarged perspective view of a portion of the refrigerator door of FIG. 1 illustrating the location of the latching arrangement of the present invention.
Figure 3:
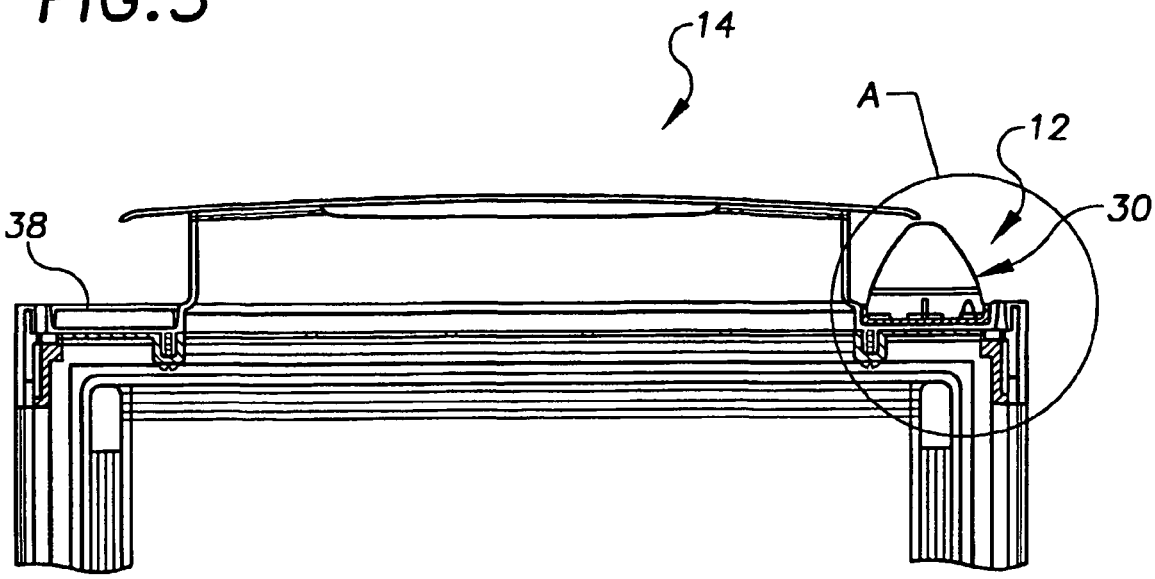
FIG. 3 is a lateral cross-sectional view taken through an upper portion of the door.
Figure 4:
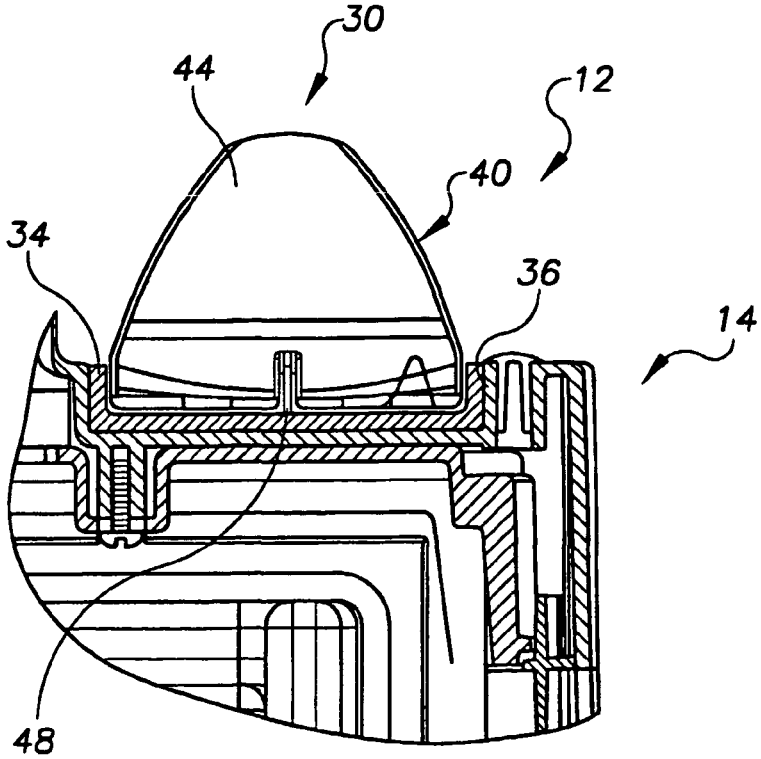
FIG. 4 is an enlarged view of the detail of circle A of FIG. 3.
Figure 5:
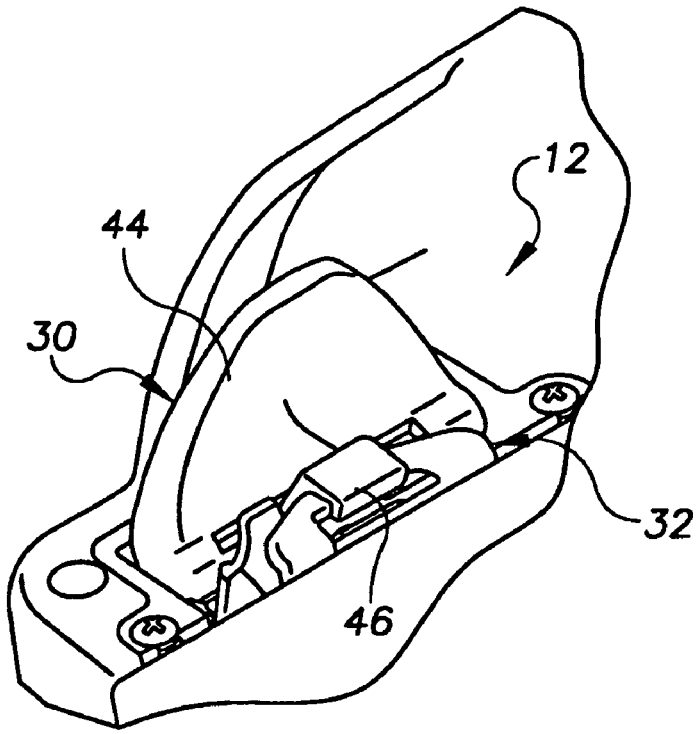
FIG. 5 is another enlarged perspective view of a portion of the refrigerator of FIG. 1, a first latching arm of the latching arrangement illustrated articulated to a first or latched position securing the door in a closed position.
Figure 6:
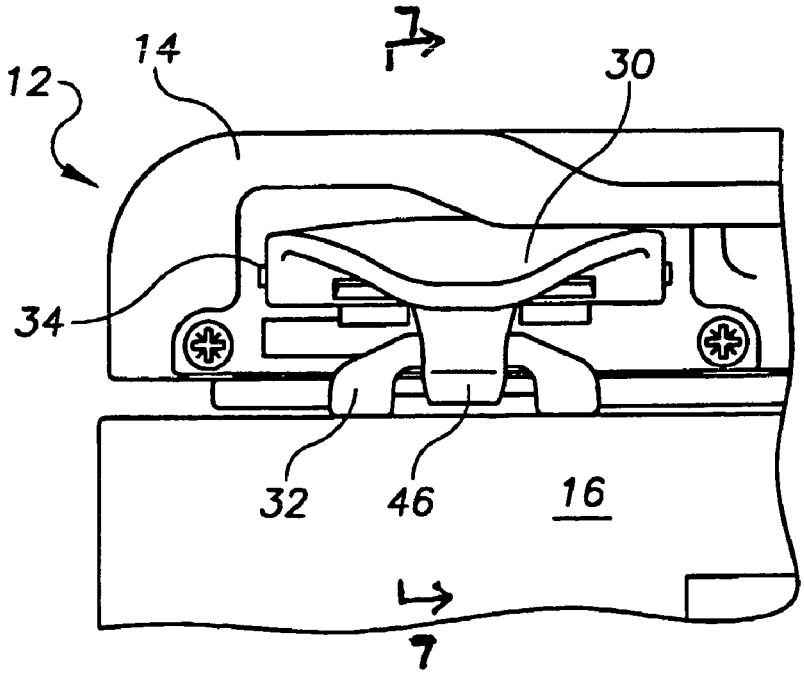
FIG. 6 is a top view of the portion of the refrigerator shown in FIG. 5.
Figure 7:
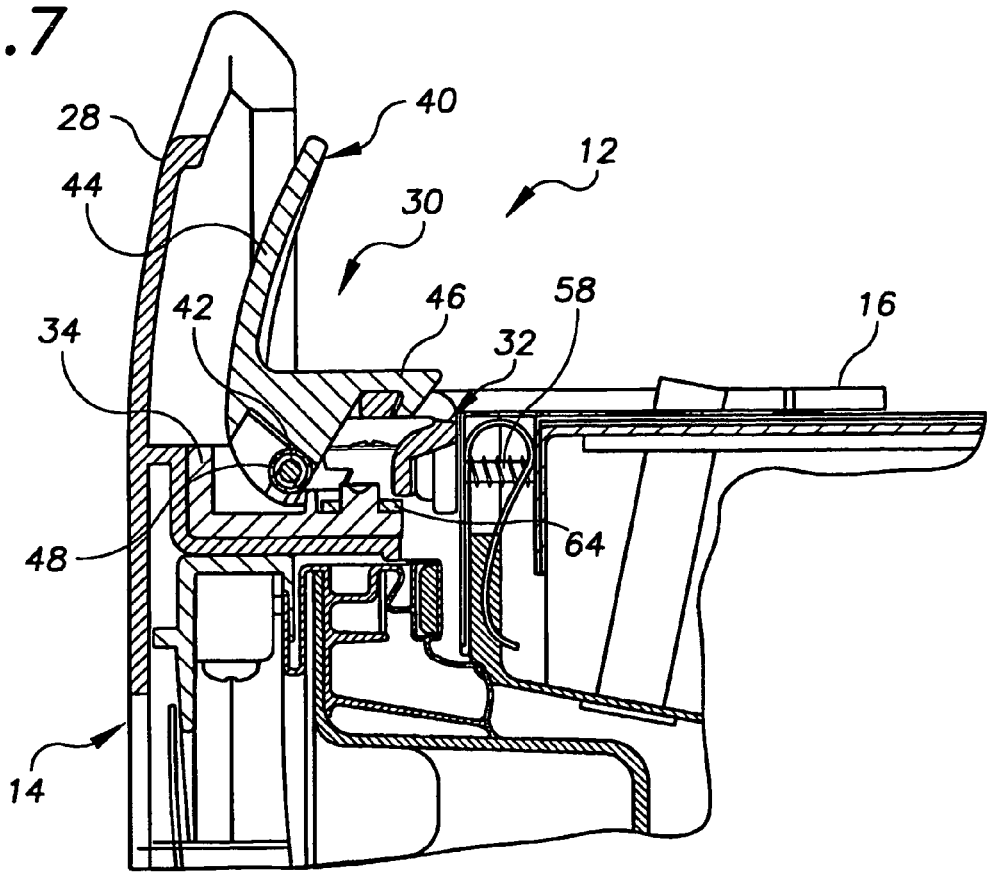
FIG. 7 is a cross-sectional view taken along the line 7—7 of FIG. 6.
Figure 8:
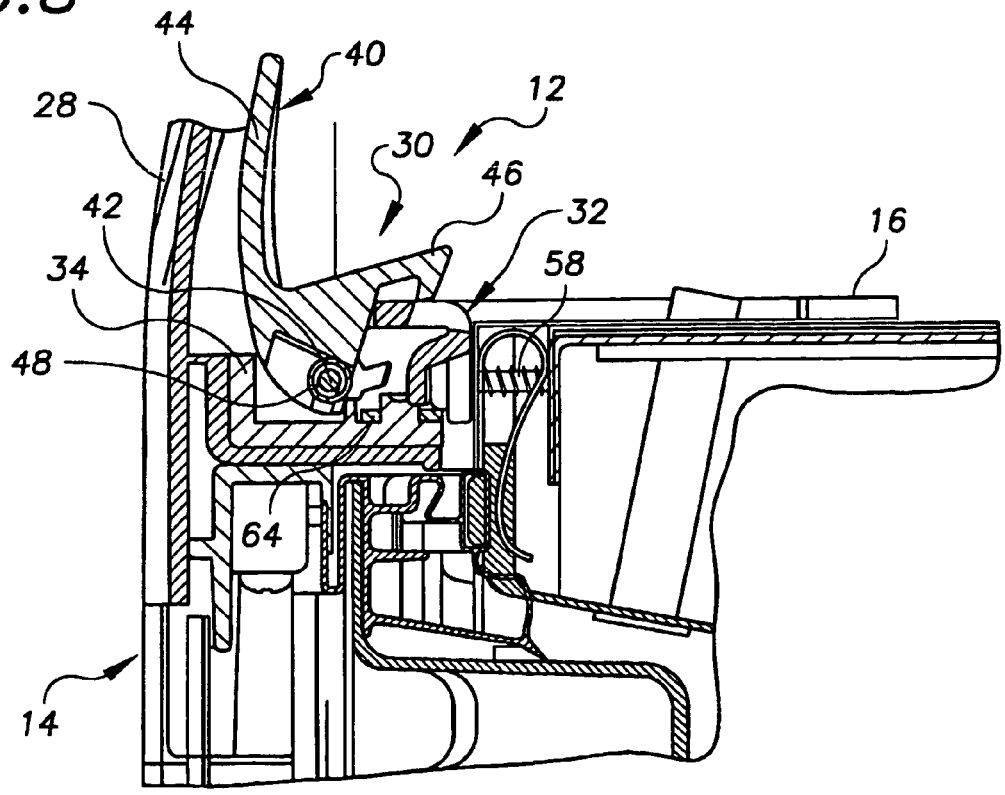
FIG. 8 is a cross-sectional view similar to FIG. 7 illustrating the first latching arm articulated to a second or unlatched position.
Figure 9:
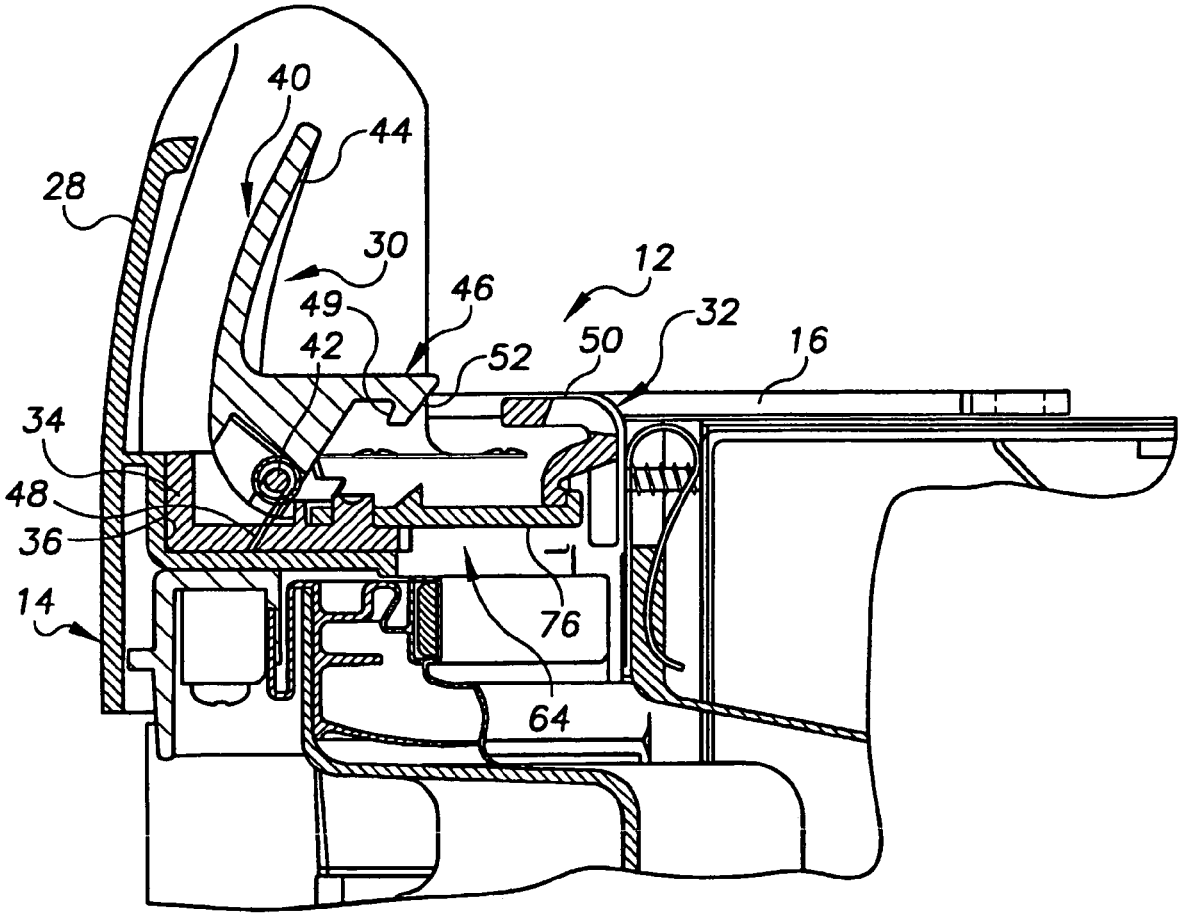
FIG. 9 is a cross-sectional view similar to FIG. 7 illustrating a second latch arm of the latching arrangement in a latched position.
Figure 10:
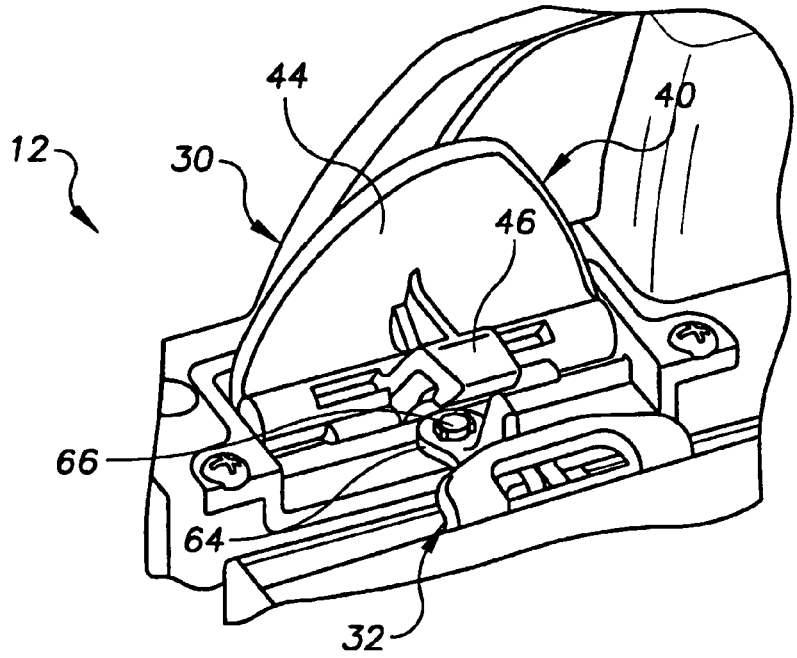
FIG. 10 is a perspective view similar to FIG. 5, but illustrating the second latch arm in the latched position.
Figure 11:
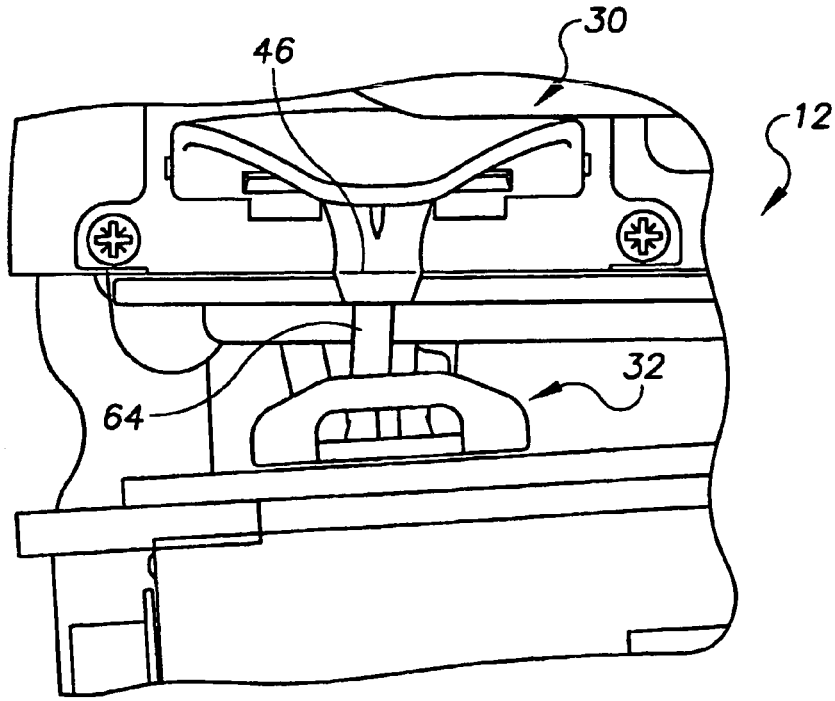
FIG. 11 is a top view similar to FIG. 6, but illustrating the second latch arm articulated to the latched position.
Figure 12:
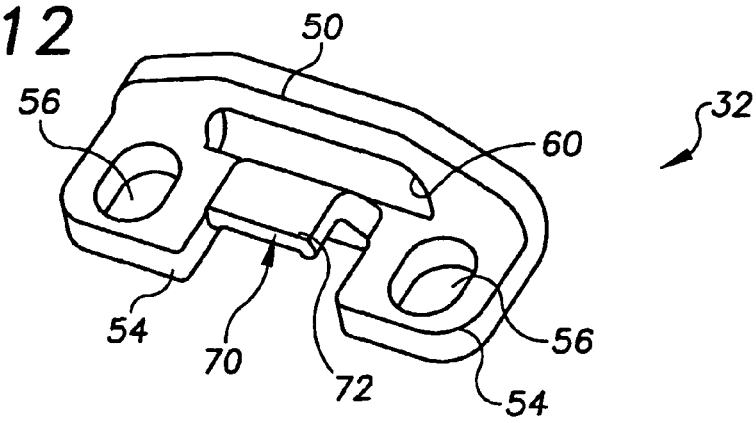
FIG. 12 is a perspective view of the striker unit.
Figure 13:
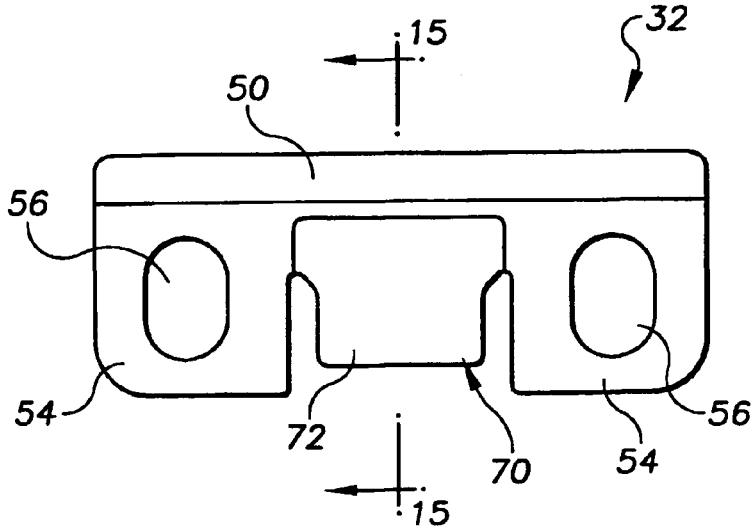
FIG. 13 is a front view of the striker unit.
Figure 14:
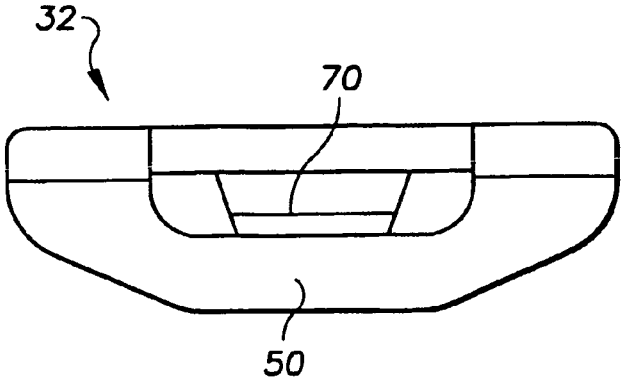
FIG. 14 is a top view of the striker unit.
Figure 15:
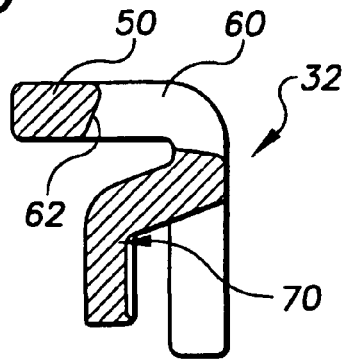
FIG. 15 is a cross-sectional view taken along the line 15—15 of FIG. 13.

With initial reference to FIGS. 1 and 2 of the drawings, a refrigerator embodying the teachings of a preferred embodiment of the present invention is illustrated and generally identified at reference character 10. The refrigerator 10 is illustrated to generally include a door assembly 14 and a cabinet 16. As will become apparent below, the subject invention is particularly directed to certain aspects of a latching arrangement 12 for securing the door assembly 14 of the refrigerator 10 to a cabinet 16. However, prior to describing the latching arrangement 12 and its operation, a brief understanding of the remainder of the exemplary refrigerator 10 shown in the drawings is warranted.

The refrigerator 10 includes a control panel 18 which carries a plurality of refrigerator controls 20. The control panel 18 upwardly extends from the cabinet 16 and is secured to the cabinet 16 with fasteners or in any other manner well known in the art. In a conventional manner, wiring (not shown) for the plurality of control 20 extends across an upper surface of the cabinet 16 and down the backside of the cabinet 16.

The door assembly 14 is mounted to the cabinet 16 for pivotal movement about an pivot axis 22 (identified in FIG. 2). In the embodiment illustrated, the pivot axis 22 couples a left hand side of the cabinet 16 with a left hand side of the door assembly 14. Alternatively, the door assembly 14 may be mounted for articulation about a right hand pivot axis.

The door assembly 14 generally includes a main body portion 26 and a cap or upper portion 28. The main body portion 26 includes a height and a width generally corresponding in size to the cabinet height and the cabinet width, respectively. The cap portion 28 is secured to and upwardly extends from the main body portion 26 of the door assembly 14. The cap portion 28 functions to substantially conceal the plurality of controls 20 when the door assembly 14 is articulated to its closed position but maintains a small access for fingers to open the door. This access is symmetrical to allow for right-hand or left-hand hinging of the door assembly 14. The construction of the door assembly 14 is further described in commonly assigned U.S. Ser. No. 60/314,984, filed Aug. 24, 2001. U.S. Ser. No. 60/314,984 is hereby incorporated by reference as if fully set forth herein.

With continued reference to FIGS. 1 and 2 and additional reference to FIGS. 3 through 15, the latching arrangement 12 of the present invention will be described in further detail. The latching arrangement 12 is illustrated to generally include a latch unit 30 and a striker unit 32. The latch unit 30 is carried by the door assembly 14. The striker unit 32 is secured to the cabinet 16.

The latch unit 30 includes a base member 34 mounted within a recess 36 defined by the door assembly 14. As shown, the latch unit 30 is mounted to the right hand side of the door assembly 14. As particularly illustrated in FIG. 3, a recess corresponding to the recess 36 is provided on the opposite side of the door assembly 14. A cover plate 38 is shown disposed in the alternative recess. Where it is desired to mount the door assembly 14 to the cabinet 16 such that the door assembly articulates about a right hand axis, the plate 38 and the latch unit 30 can interchanged.

The latch unit 30 further includes a latch member 40. The latch member 40 is pivotally mounted to the base 34 for rotation about a pivot axis defined by a pin 42. The latch member 40 includes a handle portion 44 and a first or primary latch arm 46. The latch member 40 may be pivoted between a first or latched position (shown for example in FIG. 7) and a second or unlatched position (shown for example in FIG. 8). A spring 48 biases the latch member 40 to the latched position. As illustrated in the drawings, the latch member 40 rotates in a counterclockwise position from the latched position to the unlatched position.

The handle portion 44 of the latch member 40 upwardly extends from the pivot axis 42. In the embodiment illustrated, the handle portion 44 curves rearwardly as it extends upwardly. In this manner, the handle portion 44 is generally parallel to an adjacent portion of the cap portion 28 of the door assembly 14 and in relative close proximity thereto. To facilitate opening of the door assembly 14, the handle portion 44 of the latch member 40 can be grasped in an ergonomically-efficient manner and drawn towards the cap portion 28 of the door assembly 14. Operation of the latch member 40 is effectively transparent to the user as the handle portion 44 is conveniently located immediately adjacent the cap portion 28 of the door assembly 12.

The first latch arm 46 of the latch member 40 rearwardly extends relative to the handle portion 44. The first latch arm 46 includes an undercut portion 49 (see FIG. 9) for engaging a first striker portion 50 of the striker unit 32. The first latch arm 46 further includes a tapered lead-in face 52 which engages the first striker portion 50 of the striker unit 32 as the door assembly 14 is articulated towards a closed position and rotates the latch member 40 clockwise against the bias of the spring 48.

The striker unit 32 is shown specifically in FIGS. 12 through 15. The striker unit 32 is preferably integrally formed of plastic or other suitable material and defines a pair of mounting portions 54 defining mounting apertures 56. The mounting apertures 56 receive threaded fasteners 58 (shown, for example, in FIGS. 7 and 8) which function to secure the striker unit 32 to the cabinet 16. The first striker portion 50 is illustrated to be a generally C-shaped and defines an opening 60 for receiving a distal end of the first latch arm 46. A surface 62 (specifically identified in FIG. 15) adjacent the opening 60 has a taper roughly corresponding to a cooperating surface of the first latch arm 46 for effectively securing the first latch arm 46 in its latched position.

The latch unit 30 is further illustrated to include a second latch arm or storage strap 64. The second latch arm 64 is secured to the base 34 with a fastener 66 (see, for example, FIG. 10). The fastener 66 defines a pivot axis about which the second latch arm 64 rotates between a latched position and an unlatched position. In the exemplary embodiment, the pivot axis defined by the fastener 66 is perpendicular to the pivot axis of the latch member 40. The latched position of the second latch arm 64 is shown specifically in FIGS. 9 through 11. The unlatched position of the second latch arm 64 is shown, for example, in FIGS. 7 and 8. When manually articulated to the latched position, the second latch arm 64 engages a second striker portion 70 of the striker unit 32 and maintains the door assembly 14 in an ajar position. In this manner, the interior of the cabinet 16 can be properly ventilated during periods of non-use.

The second striker portion 70 of the striker unit 30 is shown to comprise a generally L-shaped member having a downwardly extending leg 72. The downwardly extending leg 72 is preferably shown to include a rear surface with a narrowed central portion (perhaps shown most clearly in FIGS. 12 and 15) for maintaining the second latch arm 64 in the latched position.

In certain applications, it may be desirable to establish a break-away attachment between the second latch arm 64 and the second striker portion 70. To facilitate such applications, the second striker arm 64 is constructed of plastic or other suitable material which will sufficiently yield to permit a distal end 76 (see FIG. 9) to be downwardly displaced and pass by the second striker portion 70 if the door assembly 14 is sufficiently urged.

Figure 16:
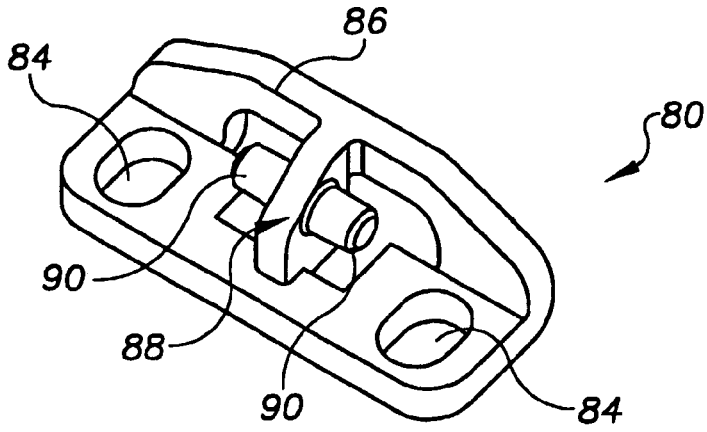
FIG. 16 is a perspective view of an alternative striker unit.
Figure 17:
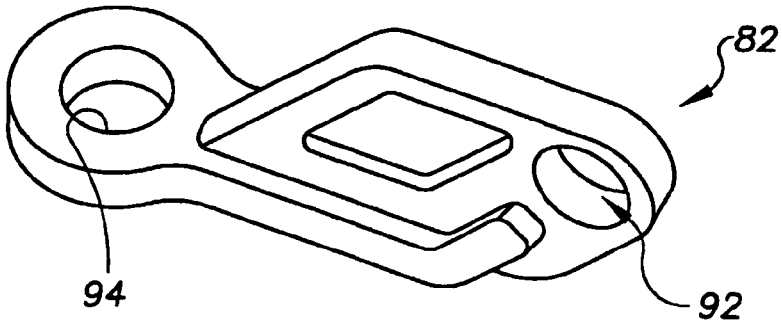
FIG. 17 is a perspective view of an alternative storage strap.
Figure 18:
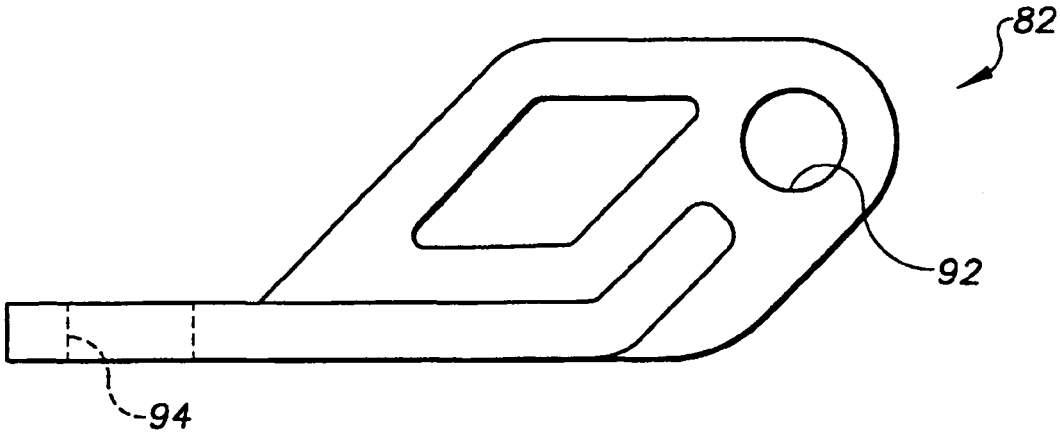
FIG. 18 is a side view of the alternative storage strap.

Turning now to FIGS. 16 through 18, an alternate striker unit 80 and a cooperating alternate second latch arm 82 will be described. The striker unit 80 is shown in the perspective view of FIG. 16. The second latch arm 82 is shown in FIGS. 17 and 18.

In a manner similar to the striker unit 32, the striker unit 80 is integrally formed to include a mounting portion defining a pair of mounting apertures 84. These mounting apertures 84 again receive threaded fasteners for securement to the cabinet 16. The striker unit 80 also similarly defines a first striker portion 86 for cooperating with the first latch arm 46.

The striker unit 80 primarily differs from the striker unit 32 in the construction and operation of a second striker portion 88 for engaging the second latch arm 82. The second striker portion 88 includes a pair of cylindrical extensions 90. The cylindrical extensions 90 are oriented and configured to be alternatively received within an opening 92 defined by the second latch arm 82.

In a manner similar to the second latch arm 64, the second latch arm 82 rotates between a latched and an unlatched position. The axis about which the second latch arm 82 rotates is defined by a fastener (not specifically shown with respect to FIGS. 17 and 18) which passes through an opening 94.

The latch arm is preferably made of an elastomeric material. One suitable material is a thermoplastic rubber commercially available under the trademark Santiprene®. Such a material facilitates a break-away connection with the striker unit 80. Those skilled in the art will appreciate that other materials may be incorporated.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A refrigerator comprising:

a door;

a cabinet; and a latching arrangement, the latching arrangement including:

a striker unit carried by the cabinet, the striker unit having first and second strikers;

a first latch arm comprising a handle portion and carried by the door and pivotable about a first axis, the first latch arm biased to a latched position into engagement with the first striker upon closing the door, and the handle portion manually accessible for releasing the first latch arm to an unlatched position for opening the door; and a second latch arm coupled to the door and pivotable about a second axis substantially perpendicular to the first axis, the second latch arm moveable between a closed-door unlatched position and a latched ajar-door position, wherein the second latch arm engages the second striker in the latched ajar-door position.

2. The refrigerator of claim 1, wherein the latching arrangement further comprising a break-away attachment between the second latch arm and the second striker when the second latch arm is in the latched position.

3. The refrigerator of claim 1, wherein the first latch arm includes an undercut portion which engages the first striker.

4. The refrigerator of claim 1, further comprising a cap coupled to the door, the cap defining an access for accessing the handle portion.

5. The refrigerator of claim 1, wherein the first and second strikers are integral portions of a single striker.

6. The refrigerator of claim 5, wherein the first striker is substantially C-shaped and defines an opening for receiving a distal end of the first latch arm.

7. The refrigerator of claim 6, wherein the second striker extends from the first striker and is substantially L-shaped.

8. The refrigerator of claim 1, further comprising a flange extending from the first striker, the flange coupled to the second striker.

9. The refrigerator of claim 8, wherein the second striker comprises a pair of cylindrical portions extending from opposite sides of the flange.

10. The refrigerator of claim 1, further comprising a cap coupled to the door, the cap defining an access for accessing the handle portion, wherein the access is symmetrical for left-hand or right-hand mounting of the door to the cabinet.

11. A refrigerator comprising:

a cabinet;

a door selectively mounted to the cabinet for right-hand or left-hand mounting to the cabinet; and a latching arrangement comprising a first latch arm carried by the door for automatically latching the door to the cabinet upon closing the door, and a second latch arm coupled to the door for latching the door in an ajar position for ventilation;

wherein the first and second arms are pivotable about substantially orthogonal first and second axes.

12. The refrigerator of claim 11, further comprising:

a striker unit carried by the cabinet, the striker unit having first and second strikers, wherein the first latch arm is biased to engage the first striker for latching the door closed, and wherein the second latch arm engages the second striker in the ajar position.

* * * * *